US009158217B2

(12) United States Patent
Takahashi et al.

(10) Patent No.: US 9,158,217 B2
(45) Date of Patent: Oct. 13, 2015

(54) TONER

(71) Applicant: CANON KABUSHIKI KAISHA, Tokyo (JP)

(72) Inventors: Toru Takahashi, Abiko (JP); Yoshihiro Ogawa, Toride (JP); Daisuke Tsujimoto, Toride (JP); Naohiko Tsuchida, Abiko (JP); Wakashi Iida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/309,469

(22) Filed: Jun. 19, 2014

(65) Prior Publication Data

US 2015/0004541 A1 Jan. 1, 2015

(30) Foreign Application Priority Data

Jun. 26, 2013 (JP) ..... 2013-134274

(51) Int. Cl.
*G03G 9/087* (2006.01)

(52) U.S. Cl.
CPC ..... *G03G 9/08755* (2013.01); *G03G 9/08782* (2013.01); *G03G 9/08791* (2013.01); *G03G 9/08795* (2013.01); *G03G 9/08797* (2013.01)

(58) Field of Classification Search
CPC ..... G03G 9/08755; G03G 9/08797; G03G 9/08795; G03G 9/08791
USPC ..... 430/109.4
See application file for complete search history.

(56) References Cited

U.S. PATENT DOCUMENTS

| | | | | |
|---|---|---|---|---|
| 5,660,963 | A * | 8/1997 | Doujo et al. | 430/109.4 |
| 5,814,428 | A | 9/1998 | Kido et al. | |
| 6,013,402 | A | 1/2000 | Kanbayashi et al. | |
| 6,071,664 | A | 6/2000 | Tavernier et al. | |
| 2013/0252167 | A1 | 9/2013 | Moribe et al. | |

FOREIGN PATENT DOCUMENTS

| | | | |
|---|---|---|---|
| EP | 0 716 351 | A2 | 6/1996 |
| JP | 4116534 | B2 | 7/2008 |
| JP | 4402023 | B2 | 1/2010 |
| JP | 4898384 | B2 | 3/2012 |

OTHER PUBLICATIONS

European Search Report dated Oct. 27, 2014 in European Application No. 14173818.7.

* cited by examiner

*Primary Examiner* — Janis L Dote
(74) *Attorney, Agent, or Firm* — Fitzpatrick, Cella, Harper and Scinto

(57) ABSTRACT

A toner comprising a binder resin and a wax, wherein the binder resin contains a binder resin A and a binder resin B, the binder resin A has a softening point of at least 120° C. and not more than 150° C., has a polyester unit, and has a terminal of which a first aliphatic compound having a melting point of 60° C. or more and not more than 85° C. has been condensed, and the binder resin B has a softening point of at least 80° C. and not more than 115° C., has a polyester unit, and has a terminal of which a second aliphatic compound having a melting point of 90° C. or more and not more than 120° C. has been condensed.

10 Claims, No Drawings

TONER

BACKGROUND OF THE INVENTION

1. Field of the Invention

The present invention relates to a toner for use in electrophotography, in image-forming methods for developing an electrostatic image, and in toner jets.

2. Description of the Related Art

The demands for higher image quality, higher speeds, and greater energy conservation have become increasingly severe in recent years in the field of image-forming devices such as copiers and printers. In addition, the use environment has also become more diverse, and excellent properties must now be maintained even in high-temperature, high-humidity environments and low-temperature, low-humidity environments. More specifically, there is a demand that high-quality images be obtained even after image formation has been carried out over a large number of prints, i.e., that an excellent endurance stability be exhibited.

On the other hand, reducing the fixation temperature of the toner is known to be effective for achieving energy conservation in, for example, copiers. Various proposals have thus already been made with the goal of improving the low-temperature fixability of toners.

For example, Japanese Patent No. 4,898,384 proposes a blend of binder resins with different softening points using polyester/styrene-acrylic hybrid resins as the binder resins.

This makes it possible to achieve a good balance between the low-temperature fixability and the endurance stability by improving the low-temperature fixability using a low softening point component while maintaining the endurance stability using a high softening point component.

However, various problems occur when the attempt is made to satisfy additional demands on the low-temperature fixability using the art of blending binder resins that have different softening points. For example, when the softening point is lowered in order to achieve the low-temperature fixability, the endurance stability may decline in high-temperature, high-humidity environments and the density may then decline with an increasing number of prints. In addition, depending on the binder resins being blended, the dispersibility of the release agent (wax) has declined and as a result fogging has been produced in low-temperature, low-humidity environments. To counter this, the chemical bonding of an aliphatic compound to the binder resin has been proposed with the goal of improving the low-temperature fixability and the wax dispersibility.

For example, in order to improve the wax dispersibility, a method in which stearic acid (70° C.) is condensed with the binder resin is proposed in Japanese Patent No. 4,116,534.

In order to improve the low-temperature fixability, a method in which a $C_{10-24}$ aliphatic compound is condensed is proposed in Japanese Patent No. 4,402,023.

Aliphatic compounds, because they have a near-wax structure, do provide an improvement in the wax dispersibility when condensed with the binder resin. Moreover, some plasticization of the binder resin is also thought to occur when a low melting point aliphatic compound is condensed with the binder resin, and it is known that the low-temperature fixability is improved by introduction into the binder resin.

However, the density of the obtained image has undergone a decline during extended use in high-temperature, high-humidity environments. High melting point aliphatic compounds, on the other hand, have a low plasticizing effect, and it has thus been quite difficult to obtain the required low-temperature fixability with them.

Thus, additional improvements are essential for achieving the even better low-temperature fixability, endurance stability, and wax dispersibility that are required by electrophotography.

SUMMARY OF THE INVENTION

The present invention provides a toner that exhibits an excellent low-temperature fixability, an excellent endurance stability, and an excellent wax dispersibility.

The present invention relates to a toner comprising a binder resin and a wax, wherein the binder resin contains a binder resin A and a binder resin B, the binder resin A:

i) has a softening point of at least 120° C. and not more than 150° C.;

ii) has a polyester unit; and iii) has a terminal of which a first aliphatic compound has been condensed, the first aliphatic compound being selected from the group consisting of an aliphatic monocarboxylic acid having a melting point of 60° C. or more and not more than 85° C., and an aliphatic monoalcohol having a melting point of 60° C. or more and not more than 85° C., and the binder resin B:

i) has a softening point of at least 80° C. and not more than 115° C.;

ii) has a polyester unit; and iii) has a terminal of which a second aliphatic compound has been condensed, the second aliphatic compound being selected from the group consisting of an aliphatic monocarboxylic acid having a melting point of 90° C. or more and not more than 120° C., and an aliphatic monoalcohol having a melting point of 90° C. or more and not more than 120° C.

The present invention can provide a toner that exhibits an excellent low-temperature fixability, an excellent endurance stability, and an excellent wax dispersibility.

Further features of the present invention will become apparent from the following description of exemplary embodiments.

DESCRIPTION OF THE EMBODIMENTS

The present inventors carried out intensive investigations into a toner that would be free of problems with the wax dispersibility and endurance stability, while also pursuing additional improvements in the low-temperature fixability. As a result, they discovered that the low-temperature fixability, endurance stability, and wax dispersibility could be achieved by blending polyester unit-containing binder resins having different softening points and by condensing aliphatic compounds having different melting points at the terminals of the respective binder resins.

Specifically, the toner of the present invention is a toner that contains a binder resin and a wax, wherein this binder resin contains a binder resin A and a binder resin B that have the following characteristic features.

The binder resin A:

i) has a softening point of at least 120° C. and not more than 150° C.;

ii) has a polyester unit; and iii) has a terminal of which a first aliphatic compound has been condensed, the first aliphatic compound being selected from the group consisting of an aliphatic monocarboxylic acid having a melting point of 60° C. or more and not more than 85° C., and an aliphatic monoalcohol having a melting point of 60° C. or more and not more than 85° C.

The binder resin B:

i) has a softening point of at least 80° C. and not more than 115° C.;

ii) has a polyester unit; and iii) has a terminal of which a second aliphatic compound has been condensed, the second aliphatic compound being selected from the group consisting of an aliphatic monocarboxylic acid having a melting point of 90° C. or more and not more than 120° C., and an aliphatic monoalcohol having a melting point of 90° C. or more and not more than 120° C.

The concept of "a binder resin has a terminal of which an aliphatic compound has been condensed" denotes, for example, a state in which a hydroxy group present in the aliphatic compound is condensed with the carboxy group of a carboxy group-terminated resin. It may also denote a state in which a carboxy group present in the aliphatic compound is condensed with the hydroxy group of a hydroxy group-terminated resin.

The reasons why this structure accrues its excellent and not heretofore available effects are not clear, but the following is thought as an approximation.

Waxes have a molecular weight distribution, within which the lower molecular weight (i.e., the lower melting point) component readily plasticizes the toner. A toner provided by the addition of wax to a conventional binder resin is affected by the lower melting point component of the wax and its endurance stability then declines, and in some cases the image density has undergone a decline during extended use.

The present invention is characterized by the presence of a low melting point (at least 60° C. and not more than 85° C.) aliphatic compound at a terminal of the high softening point (softening point of at least 120° C. and not more than 150° C.) binder resin A and the presence of a high melting point (at least 90° C. and not more than 120° C.) aliphatic compound at a terminal of the low softening point (softening point of at least 80° C. and not more than 115° C.) binder resin B.

The aliphatic compound used in the present invention, e.g., an aliphatic monoalcohol or an aliphatic monocarboxylic acid, has a hydrocarbon as a constituent unit and as a consequence exhibits a high affinity with waxes and can thus improve the wax dispersibility in the binder resin. Fogging in low-temperature, low-humidity environments can be substantially inhibited as a result.

The binder resin A and the binder resin B of the present invention both have a unit originating from the aliphatic compound at their terminals, and due to this the wax is readily dispersible in both binder resins. It is theorized, however, that the lower melting point component of the wax readily selectively associates with the low melting point aliphatic compound of the binder resin A and that the higher melting point component of the wax readily selectively associates with the high melting point aliphatic compound of the binder resin B. As a result, the binder resin A, which has a high softening point, is readily influenced by the lower melting point component of the wax, and as a consequence is readily plasticized by the wax during fixing and the low-temperature fixability is thereby improved. In addition, it is thought that the binder resin B, which has a low softening point, is little influenced by the lower melting point component of the wax and the problem of a reduction in the image density during extended use can then be suppressed.

The present invention is described in greater detail in the following. The binder resin is described first.

The softening point of the binder resin A in the present invention is at least 120° C. and not more than 150° C. and is preferably at least 125° C. and not more than 145° C. The melting point of the aliphatic compound condensed at the terminal of the binder resin A is at least 60° C. and not more than 85° C. and is preferably at least 65° C. and not more than 80° C.

When the softening point of the binder resin A is less than 120° C., it takes on a value near to that of the softening point of the binder resin B, and as a consequence the mixability between the binder resin A and the binder resin B is excellent and a uniform mixed state is easily produced for the binder resins. However, the wax dispersibility is reduced, and the fogging performance and the endurance stability are thereby reduced. When 150° C. is exceeded, good mixing with the binder resin B is then quite difficult to obtain and the fogging performance and endurance stability are reduced as a result. Moreover, the endurance stability is reduced when the melting point of the aliphatic compound is less than 60° C. When the melting point of the aliphatic compound exceeds 85° C., the occurrence of the selective association of the lower melting point component of the wax is suppressed and the wax dispersibility is reduced and together with this the endurance stability is reduced due to plasticization of the binder resin B by the wax.

The softening point of the binder resin B in the present invention is at least 80° C. and not more than 115° C. and is preferably at least 85° C. and not more than 105° C. The melting point of the aliphatic compound condensed to the terminal of the binder resin B is at least 90° C. and not more than 120° C. and is preferably at least 95° C. and not more than 110° C.

When the softening point of the binder resin B is less than 80° C., the fix strength for the fixed toner is reduced and peeling readily occurs and the low-temperature fixability is reduced as a result. At above 115° C., melting by the toner is made difficult and the low-temperature fixability is impaired. When, on the other hand, the melting point of the aliphatic compound is less than 90° C., the lower melting point component of the wax will then also readily exercise an effect on the binder resin B and the endurance stability and fogging performance will decline. When the melting point of the aliphatic compound is greater than 120° C., the wax dispersibility declines and the endurance stability and fogging performance are reduced as a result.

Letting the softening point of the binder resin A be Tm(A) and the softening point of the binder resin B be Tm(B), Tm(A)−Tm(B) in the present invention is preferably at least 20° C. and not more than 55° C. and more preferably is at least 20° C. and not more than 40° C. The dispersibility of the resins with each other is improved by having Tm(A)−Tm(B) be in the indicated range, and as a result additional improvements are obtained in the wax dispersibility.

The softening points of the binder resin A and the binder resin B can be adjusted into the indicated ranges using the reaction temperature and the reaction time during binder resin synthesis.

Both the binder resin A and the binder resin B have a polyester unit in the present invention. In the present invention, this "polyester unit" denotes a unit that originates from a polyester, and a resin having a polyester unit encompasses, for example, polyester resins and hybrid resins in which a polyester unit is bonded to another resin unit. This other resin can be exemplified by vinylic resins, polyurethane resins, epoxy resins, phenolic resins, and so forth. Since polyester resins are a binder resin that exhibits an excellent low-temperature fixability, a binder resin having a polyester unit is used to achieve a better low-temperature fixability.

A characteristic feature of the binder resin A and the binder resin B used by the present invention is that these are resins in which at least one aliphatic compound selected from the group consisting of aliphatic monocarboxylic acids and aliphatic monoalcohols is condensed to the terminal of each of the resins. Here, when the binder resin A or binder resin B has a branched structure, the "terminal" also encompasses the terminals provided by this branching.

It is crucial that this aliphatic compound have a monovalent functionality. The aliphatic compound is then able to condense to the binder resin terminal through this monovalency. This is thought to make possible an effective increase in the affinity with the wax as a result.

The relationship between the softening point of the particular binder resin and the melting point of the aliphatic compound condensed at the terminal of this resin is crucial in the present invention. The melting point of the aliphatic compound is regarded as a physical quantity that directly represents the intermolecular forces for the compound. That is, since the affinity between molecules is higher for compounds for which the melting points are closer, it is crucial for considering the affinity with the wax in the present invention.

The binder resin A in the present invention is preferably a hybrid resin in which a vinyl polymer unit is chemically bonded with a polyester unit. The use of a hybrid resin for the binder resin A provides a better charging stability and an improvement in fogging.

The binder resin B, on the other hand, is preferably a polyester resin. Polyester resin has a better low-temperature fixability than the hybrid resin but a poorer compatibility with waxes, which facilitates a worsening of the wax dispersibility. Since the binder resin B contains an aliphatic compound in the present invention, it thus has an adequate wax-dispersing function. Thus, by having the low softening point binder resin B be a polyester resin, the low-temperature fixability is further enhanced without causing a deterioration in the wax dispersibility.

The mixing ratio, expressed on a mass basis, between the binder resin A and the binder resin B (binder resin A:binder resin B) in the toner of the present invention is preferably 10:90 to 90:10. It is more preferably 20:80 to 80:20 and is even more preferably 40:60 to 80:20. An even better low-temperature fixability, endurance stability, and wax dispersibility are obtained by having the mass ratio between the binder resin A and the binder resin B be in the indicated range.

Insofar as the effects of the present invention are not impaired, the binder resin in the present invention may contain a resin other than the binder resin A and the binder resin B. The binder resins used in toners may be used as this other resin without particular limitation and can be exemplified by vinyl resins, polyurethane resins, epoxy resins, and phenolic resins.

The components constituting the polyester unit are described in the following. Of the various components indicated in the following, one or two or more may be used in conformity with the type and application.

The divalent acid component constituting the polyester unit can be exemplified by the following dicarboxylic acids and their derivatives: benzenedicarboxylic acids and their anhydrides and lower alkyl esters, e.g., phthalic acid, terephthalic acid, isophthalic acid, and phthalic anhydride; alkyldicarboxylic acids such as succinic acid, adipic acid, sebacic acid, and azelaic acid, and their anhydrides and lower alkyl esters; succinic acids having a $C_{1-50}$ alkenyl group and succinic acids having a $C_{1-50}$ alkyl group, and their anhydrides and lower alkyl esters; and unsaturated dicarboxylic acids such as fumaric acid, maleic acid, citraconic acid, and itaconic acid, and their anhydrides and lower alkyl esters.

The dihydric alcohol component that constitutes the polyester unit, on the other hand, can be exemplified by the following: ethylene glycol, polyethylene glycol, 1,2-propanediol, 1,3-propanediol, 1,3-butanediol, 1,4-butanediol, 2,3-butanediol, diethylene glycol, triethylene glycol, 1,5-pentanediol, 1,6-hexanediol, neopentyl glycol, 2-methyl-1,3-propanediol, 2-ethyl-1,3-hexanediol, 1,4-cyclohexanedimethanol (CHDM), hydrogenated bisphenol A, bisphenols as represented by formula (1) and their derivatives, and diols as represented by formula (2)

[Chem 1]

(1)

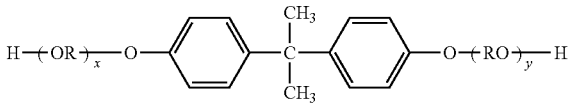

(in the formula, R is an ethylene or propylene group; x and y are both integers equal to or greater than 0; and the average value of x+y is 0 to 10)

[Chem 2]

(2)

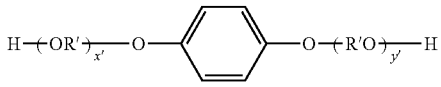

(in the formula, R' is —$CH_2CH_2$—,

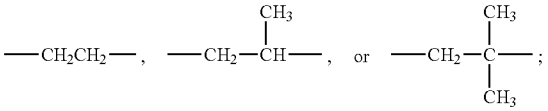

x' and y' are both integers equal to or greater than 0; and the average value of x'+y' is 0 to 10).

In addition to the divalent carboxylic acid compounds and dihydric alcohol compounds indicated above, the constituent components of the polyester unit that is used in the present invention may include trivalent and higher valent carboxylic acid compounds and trihydric and higher hydric alcohol compounds.

The trivalent and higher valent carboxylic acid compounds are not particularly limited and can be exemplified by trimellitic acid, trimellitic anhydride, and pyromellitic acid. The trihydric and higher hydric alcohol compounds can be exemplified by trimethylolpropane, pentaerythritol, and glycerol.

There are no particular limitations on the method of producing the polyester unit in the present invention and known methods can be used. For example, the previously indicated divalent carboxylic acid compound and dihydric alcohol compound may be charged at the same time as the aliphatic monocarboxylic acid or aliphatic monoalcohol and a polymerization may then be run via an esterification or transesterification reaction and a condensation reaction to produce a polyester resin. The polymerization temperature is also not particularly limited, but the range of at least 180° C. and not more than 290° C. is preferred. A polymerization catalyst can be used in the polymerization of the polyester unit, e.g., a titanium catalyst, a tin catalyst, zinc acetate, antimony trioxide, germanium dioxide, and so forth. In particular, the binder resin in the present invention more preferably contains a polyester unit provided by polymerization using a titanium catalyst.

The titanium compound can be specifically exemplified by titanium diisopropylate bistriethanolaminate ($Ti(C_6H_{14}O_3N)_2(C_3H_7O)_2$), titanium diisopropylate bisdiethanolaminate ($Ti(C_4H_{10}O_2N)_2(C_3H_7O)_2$), titanium dipentylate bistriethanolaminate ($Ti(C_6H_{14}O_3N)_2(C_5H_{11}O)_2$), titanium diethylate bistriethanolaminate ($Ti(C_6H_{14}O_3N)_2(C_2H_5O)_2$), titanium dihydroxyoctylate bistriethanolaminate ($Ti(C_6H_{14}O_3N)_2(OHC_8H_{16}O)_2$), titanium distearate bistriethanolaminate ($Ti(C_6H_{14}O_3N)_2(C_{19}H_{37}O)_2$), titanium triisopropylate triethanolaminate ($Ti(C_6H_{14}O_3N)_1(C_3H_7O)_3$), and titanium monopropylate tris(triethanolaminate) ($Ti(C_6H_{14}O_3N)_3(C_3H_7O)_1$), where among titanium diisopropylate bistriethanolaminate, titanium diisopropylate bisdiethanolaminate, and titanium dipentylate bistriethanolaminate are preferred.

Specific examples of other titanium catalysts are tetra-n-butyl titanate ($Ti(C_4H_9O)_4$), tetrapropyl titanate ($Ti(C_3H_7O)_4$), tetrastearyl titanate ($Ti(C_{18}H_{37}O)_4$), tetramyristyl titanate ($Ti(C_{14}H_{29}O)_4$), tetraoctyl titanate ($Ti(C_8H_{17}O)_4$), dioctyl dihydroxyoctyl titanate ($Ti(C_8H_{17}O)_2(OHC_8H_{16}O)_2$), and dimyristyl dioctyl titanate ($Ti(C_{14}H_{29}O)_2(C_8H_{17}O)_2$), where among tetrastearyl titanate, tetramyristyl titanate, tetraoctyl titanate, and dioctyl dihydroxyoctyl titanate are preferred. These can be obtained, for example, by reacting a titanium halide with the corresponding alcohol. The titanium compound more preferably contains an aromatic carboxylic acid titanium compound. This aromatic carboxylic acid titanium compound is preferably an aromatic carboxylic acid titanium compound obtained by reacting an aromatic carboxylic acid with a titanium alkoxide. The aromatic carboxylic acid is preferably a divalent or higher valent aromatic carboxylic acid (i.e., an aromatic carboxylic acid that has two or more carboxyl groups) and/or an aromatic hydroxycarboxylic acid. This divalent or higher valent aromatic carboxylic acid can be exemplified by dicarboxylic acids such as phthalic acid, isophthalic acid, and terephthalic acid, and their anhydrides, and by polyvalent carboxylic acids such as trimellitic acid, benzophenone dicarboxylic acid, benzophenone tetracarboxylic acid, naphthalene dicarboxylic acid, and naphthalene tetracarboxylic acid and their anhydrides and esters. The aromatic hydroxycarboxylic acid can be exemplified by salicylic acid, m-hydroxybenzoic acid, p-hydroxybenzoic acid, gallic acid, mandelic acid, and tropic acid. Among the preceding, the use of divalent and higher valent carboxylic acids for the aromatic carboxylic acid is more preferred, and the use of isophthalic acid, terephthalic acid, trimellitic acid, and naphthalenedicarboxylic acid is particularly preferred.

Preferably at least styrene is used for the vinylic monomer used to produce the vinylic polymer unit in the hybrid resin in the present invention. The endurance stability is further enhanced since the aromatic ring accounts for a large proportion of the molecular structure of styrene. The styrene content in the vinyl monomer is preferably at least 70 mol % and more preferably at least 85 mol %.

The following styrenic monomers and acrylic acid-type monomers are examples of vinyl monomers other than styrene that may be used to produce the vinyl polymer unit.

Examples of the styrenic monomer are styrene derivatives such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene.

The acrylic acid-type monomer can be exemplified by acrylic acid and acrylate esters, e.g., acrylic acid, methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; α-methylene aliphatic monocarboxylic acids and their esters, e.g., methacrylic acid, methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and acrylic acid derivatives and methacrylic acid derivatives, e.g., acrylonitrile, methacrylonitrile, and acrylamide.

The monomer constituting the vinyl polymer unit can also be exemplified by hydroxyl group-bearing monomers, e.g., acrylate and methacrylate esters such as 2-hydroxyethyl acrylate, 2-hydroxyethyl methacrylate, and 2-hydroxypropyl methacrylate, and also 4-(1-hydroxy-1-methylbutyl)styrene and 4-(1-hydroxy-1-methylhexyl) styrene.

Various monomers capable of vinyl polymerization may additionally be used on an optional basis in the vinyl polymer unit. These monomers can be exemplified by ethylenically unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; the halfesters of unsaturated dibasic acids, e.g., the methyl halfester of maleic acid, the ethyl halfester of maleic acid, the butyl halfester of maleic acid, the methyl halfester of citraconic acid, the ethyl halfester of citraconic acid, the butyl halfester of citraconic acid, the methyl halfester of itaconic acid, the methyl halfester of an alkenylsuccinic acid, the methyl halfester of fumaric acid, and the methyl halfester of mesaconic acid; the esters of unsaturated dibasic acids, e.g., dimethyl maleate and dimethyl fumarate; the anhydrides of α,β-unsaturated acids such as acrylic acid, methacrylic acid, crotonic acid, and cinnamic acid; anhydrides between such α,β-unsaturated acids and lower aliphatic acids; and carboxyl group-containing monomers such as alkenylmalonic acid, alkenylglutaric acid, and alkenyladipic acid as well as their anhydrides and monoesters.

This vinyl polymer unit may as necessary also be a polymer that has been crosslinked using a crosslinking monomer as exemplified by the following. This crosslinking monomer is exemplified by aromatic divinyl compounds, diacrylate compounds with an alkyl chain linker, diacrylate compounds having an alkyl chain linker that contains an ether linkage, diacrylate compounds in which linkage is through a chain that has an aromatic group and an ether linkage, polyester-type diacrylates, and multifunctional crosslinking agents.

The aromatic divinyl compounds can be exemplified by divinylbenzene and divinylnaphthalene.

The above-referenced diacrylate compounds with an alkyl chain linker can be exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and compounds provided by replacing the acrylate in the preceding compounds with methacrylate.

The above-referenced diacrylate compounds having an alkyl chain linker that contains an ether linkage can be exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and compounds provided by replacing the acrylate in the preceding compounds with methacrylate.

The above-referenced diacrylate compounds in which linkage is through a chain that has an aromatic group and an ether linkage can be exemplified by polyoxyethylene(2)-2,2-bis(4-hydroxyphenyl)propane diacrylate, polyoxyethylene (4)-2,2-bis(4-hydroxyphenyl)propane diacrylate, and compounds provided by replacing the acrylate in the preceding compounds with methacrylate. The polyester-type diacrylates can be exemplified by MANDA (product name, from Nippon Kayaku Co., Ltd.).

The above-referenced multifunctional crosslinking agents can be exemplified by pentaerythritol triacrylate, trimethylolethane triacrylate, trimethylolpropane triacrylate, tetramethylolmethane tetraacrylate, oligoester acrylate, and compounds provided by replacing the acrylate in the preceding compounds with methacrylate, as well as triallyl cyanurate and triallyl trimellitate.

The vinyl polymer unit may be a resin that has been produced using a polymerization initiator. Considering the efficiency, the polymerization initiator is preferably used at at least 0.05 mass parts and not more than 10 mass parts per 100 mass parts of the monomer.

The polymerization initiator can be exemplified by 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl 2,2'-azobisisobutyrate, 1,1'-azobis(1-cyclohexanecarbonitrile), 2-carbamoylazoisobutyronitrile, 2,2'-azobis(2,4,4-trimethylpentane), 2-phenylazo-2,4-dimethyl-4-methoxyvaleronitrile, 2,2'-azobis(2-methylpropane), ketone peroxides (e.g., methyl ethyl ketone peroxide, acetylacetone peroxide, cyclohexanone peroxide), 2,2-bis(t-butylperoxy)butane, t-butyl hydroperoxide, cumene hydroperoxide, 1,1,3,3-tetramethylbutyl hydroperoxide, di-t-butyl peroxide, t-butyl cumyl peroxide, dicumyl peroxide, α,α'-bis(t-butylperoxyisopropyl) benzene, isobutyl peroxide, octanoyl peroxide, decanoyl peroxide, lauroyl peroxide, 3,5,5-trimethylhexanoyl peroxide, benzoyl peroxide, m-toluoyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxy isopropyl carbonate, di-t-butyl peroxyisophthalate, t-butylperoxy allyl carbonate, t-amylperoxy 2-ethylhexanoate, di-t-butylperoxy hexahydroterephthalate, and di-t-butylperoxy azelate.

The hybrid resin referenced above is a resin in which the polyester unit is chemically bonded to the vinyl polymer unit.

Due to this, the polymerization is preferably carried out using a compound capable of reacting with monomer for both of the resins (referred to below as a "dual reactive compound"). Among monomers for condensation polymerization-type resins and monomers for addition polymerization-type resins, such dual reactive compounds can be exemplified by fumaric acid, acrylic acid, methacrylic acid, citraconic acid, maleic acid, and dimethyl fumarate. The use of fumaric acid, acrylic acid, and methacrylic acid among the preceding is preferred.

With regard to the method for obtaining the hybrid resin, it can be obtained by the simultaneous or sequential reaction of the starting monomer for the polyester unit and the starting monomer for the vinyl polymer unit. For example, facile control of the molecular weight can be obtained by carrying out the addition polymerization reaction of the monomer for the vinyl (co)polymer followed by the condensation polymerization reaction of the starting monomer for the polyester unit.

The mixing ratio, on a mass basis, between the polyester unit and vinyl polymer unit (polyester unit/vinyl polymer unit) in the hybrid resin is preferably 50/50 to 90/10 from the standpoint of control of the crosslinking structures at the molecular level, while 50/50 to 80/20 is more preferred. An excellent low-temperature fixability is obtained by having a polyester unit content of at least 50 mass %, while an excellent charging stability and an improved fogging performance are obtained by having a vinyl polymer unit content of at least 10 mass %.

At least one aliphatic compound selected from the group consisting of aliphatic monocarboxylic acids having a melting point of at least 60° C. and not more than 85° C. and aliphatic monoalcohols having a melting point of at least 60° C. and not more than 85° C., is condensed to a terminal of the binder resin A in the present invention. On the other hand, at least one aliphatic compound selected from the group consisting of aliphatic monocarboxylic acids having a melting point of at least 90° C. and not more than 120° C. and aliphatic monoalcohols having a melting point of at least 90° C. and not more than 120° C., is condensed to a terminal of the binder resin B.

The aliphatic compound used in the present invention should be an aliphatic monocarboxylic acid having the specified melting point or an aliphatic monoalcohol having the specified melting point, but is not otherwise particularly limited. For example, a primary, secondary, or tertiary aliphatic compound may be used.

The aliphatic monocarboxylic acid can be specifically exemplified by palmitic acid, stearic acid, arachidic acid, and behenic acid, and by cerotic acid, heptacosanoic acid, montanic acid, melissic acid, lacceric acid, tetracontanoic acid, and pentacontanoic acid.

The aliphatic monoalcohol can be exemplified by behenyl alcohol, ceryl alcohol, melissyl alcohol, and tetracontanol.

In addition, the aliphatic compound used by the present invention may, as long as it has the melting point specified by the present invention, be a compound generally used as a modified wax (for example, an acid-modified aliphatic hydrocarbon wax or an alcohol-modified aliphatic hydrocarbon wax).

These modified waxes do not impair the effects of the present invention as long as the mixture of zero valent, monovalent, and multivalent components has a content of monovalent modified wax of at least 40 mass %.

Specific examples of these acid-modified aliphatic hydrocarbon waxes and alcohol-modified aliphatic hydrocarbon waxes are provided below.

The acid-modified aliphatic hydrocarbon waxes in the present invention are preferably acid-modified aliphatic hydrocarbon waxes provided by the modification of polyethylene or polypropylene with a monovalent unsaturated carboxylic acid such as acrylic acid. The melting point of the acid-modified wax can be controlled through the molecular weight.

Among the alcohol-modified aliphatic hydrocarbon waxes, primary alcohol-modified aliphatic hydrocarbon waxes can be obtained, for example, by the following method: ethylene is polymerized using a Ziegler catalyst; after the polymerization has been completed, oxidation is carried out to produce an alkoxide between the catalyst metal and the polyethylene; and hydrolysis is then carried out.

The process for producing a secondary alcohol-modified aliphatic hydrocarbon wax can be exemplified by liquid-phase oxidation of the aliphatic hydrocarbon wax preferably in the presence of boric acid and boric anhydride and with a gas that contains molecular oxygen. The resulting hydrocarbon wax may be purified by a press sweating method, or may be purified using a solvent, or may be treated with hydrogen, or may be treated with active clay after a sulfuric acid wash. A mixture of boric acid and boric anhydride can be used as the catalyst. The mixing ratio between the boric acid and boric anhydride (boric acid/boric anhydride), expressed as the molar ratio, is preferably in the range from 1 to 2 and more preferably in the range from 1.2 to 1.7. A boric anhydride proportion that is less than the indicated range is unfavorable because the excess boric acid causes aggregation phenomena. A boric anhydride proportion greater than the indicated range is also unfavorable in economic terms because a particulate material originating from the boric anhydride is recovered after the reaction and the excess boric anhydride does not contribute to the reaction.

The amount of addition of the boric acid and boric anhydride used is preferably, in terms of amount of boric acid of the mixture, 0.001 to 10 moles and particularly 0.1 to 1 mole per 1 mole of the starting aliphatic hydrocarbon. Metaboric acid and pyroboric acid may also be used besides boric acid/boric anhydride. The oxoacids of boron, the oxoacids of phosphorus, and the oxoacids of sulfur are examples of species that form ester with an alcohol. Specific examples are boric acid, nitric acid, phosphoric acid, and sulfuric acid.

Oxygen, air, or these diluted with an inert gas over a broad range can be used as the molecular oxygen-containing gas that is injected into the reaction system. The gas preferably has an oxygen concentration of 1 to 30 volume % and more preferably 3 to 20 volume %.

The liquid-phase oxidation reaction generally does not use a solvent and is carried out with the starting aliphatic hydrocarbon in a molten state. The reaction temperature is 120° C. to 280° C. and preferably 150° C. to 250° C. The reaction time is preferably 1 to 15 hours.

The boric acid and boric anhydride are preferably premixed and then added to the reaction system. The addition of only boric acid by itself is unfavorable because, for example, a boric acid dehydration reaction occurs. The temperature of addition of the boric acid/boric anhydride mixed catalyst should be 100° C. to 180° C. and is preferably 110° C. to 160° C. Below 100° C. is unfavorable because the catalytic function of the boric anhydride is then lowered due to, for example, moisture remaining in the system.

An alcohol-modified aliphatic hydrocarbon wax bearing the desired functional group is obtained by adding water to the reaction mixture after the completion of the reaction, hydrolyzing the produced borate ester of the aliphatic hydrocarbon wax, and purifying.

Aliphatic monoalcohols are preferred among the aliphatic compounds described above, and alcohol-modified aliphatic hydrocarbon waxes are more preferred.

Through the condensation of the indicated aliphatic compound at the terminal of the binder resin A and the binder resin B and more preferably its condensation at the terminal of the polyester unit present in the binder resin A and binder resin B, the aliphatic compound can partially plasticize the binder resin and the low-temperature fixability can then be improved. Moreover, it is thought that the wax dispersibility is improved through an increase in the affinity between the binder resin and the wax.

A secondary alcohol-modified aliphatic hydrocarbon wax is more preferred for the aliphatic compound that condenses to the terminal of the binder resin A. On the other hand, a primary alcohol-modified aliphatic hydrocarbon wax is more preferred for the aliphatic compound that condenses to the terminal of the binder resin B. The dispersibility of the binder resin is improved further and the wax dispersibility is improved further by condensing a secondary alcohol-modified aliphatic hydrocarbon wax to the binder resin A and a primary alcohol-modified aliphatic hydrocarbon wax to the binder resin B.

The difference (MpB−MpA) between the melting point (MpA) of the aliphatic compound condensed to the terminal of the binder resin A and the melting point (MpB) of the aliphatic compound condensed to the terminal of the binder resin B is preferably at least 15° C. and not more than 60° C. and more preferably at least 15° C. and not more than 45° C. The wax dispersibility is further improved, and thus the fogging performance and endurance stability are further improved, by controlling this melting point difference into the indicated range.

There are no particular limitations on the method for condensing the aliphatic compound to the terminals of the binder resin A and the binder resin B. In a preferred embodiment, the binder resin A and the binder resin B are preferably produced by carrying out a condensation polymerization with the aliphatic compound being added at the same time to the monomer constituting the polyester unit present in the binder resin A and the binder resin B. This makes possible a thorough condensation of the aliphatic compound at the terminals of the polyester unit present in the binder resin A and the binder resin B. The wax dispersibility and low-temperature fixability are further enhanced as a result.

The amount of addition of the aliphatic compound, expressed per 100 mass parts of the total monomer constituting the polyester unit, is preferably at least 1 mass part and not more than 10 mass parts and more preferably at least 3 mass parts and not more than 7 mass parts.

The toner in the present invention contains a wax in order to impart releasability to the toner. Viewed in terms of the ease of dispersion in the toner, the extent of the releasability, and the affinity with the aliphatic compounds that characterize the present invention, this wax is preferably a hydrocarbon wax. Examples are low molecular weight polyethylene, low molecular weight polypropylene, microcrystalline wax, paraffin wax, and Fischer-Tropsch waxes. As necessary, one or two or more waxes may also be co-used in a minor amount. The following are examples:

oxides of aliphatic hydrocarbon waxes, such as oxidized polyethylene wax, and their block copolymers; waxes in which the major component is fatty acid ester, such as carnauba wax, sasol wax, and montanic acid ester waxes; waxes provided by the partial or complete deacidification of fatty acid esters, such as deacidified carnauba wax; waxes provided by grafting an aliphatic hydrocarbon wax using a vinyl monomer such as styrene or acrylic acid; partial esters between a polyhydric alcohol and a fatty acid, such as behenic monoglyceride; and hydroxyl group-containing methyl ester compounds obtained by the hydrogenation of plant oils.

In addition to these waxes, the following compounds may also be co-used: saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; long-chain alkyl alcohols; polyhydric alcohols such as sorbitol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N-dioleylsebacamide; aromatic bisamides such as m-xylenebisstearamide and N,N-distearylisophthalamide; and fatty acid metal salts (generally known as metal soaps) such as calcium stearate, calcium laurate, zinc stearate, and magnesium stearate.

Specific examples are as follows: VISKOL (registered trademark) 330-P, 550-P, 660-P, and TS-200 (Sanyo Chemical Industries, Ltd.); Hi-WAX 400P, 200P, 100P, 410P, 420P, 320P, 220P, 210P, and 110P (Mitsui Chemicals, Inc.); Sasol H1, H2, C80, C105, C77 (Sasol Wax GmbH); HNP-1, HNP-3, HNP-9, HNP-10, HNP-11, and HNP-12 (Nippon Seiro Co., Ltd.); UNILIN (registered trademark) 350, 425, 550, and 700 and UNICID (registered trademark) 350, 425, 550, and 700 (Toyo Petrolite Co., Ltd.); and Japan Wax, Beeswax, Rice Wax, Candelilla Wax, and Carnauba Wax (Cerarica NODA Co., Ltd.).

With regard to the timing of wax addition, it may be added during melt kneading during toner production or during production of the binder resin, and a suitable selection from existing methods can be used.

In order to realize additional improvements in the wax dispersibility, preferably the entire amount of the wax is added in the present invention during the production of a binder resin A that is a hybrid resin.

In order to realize additional enhancements in the dispersibility into the binder resin of the present invention, the melting point of the wax is preferably at least 60° C. and not more than 150° C. and is more preferably at least 70° C. and not more than 140° C.

Per 100 mass parts of the binder resin, the wax is preferably added at at least 1 mass part and not more than 20 mass parts, more preferably at least 1 mass part and not more than 10 mass parts, and even more preferably at from 1 mass part to 7 mass parts. The releasing action provided by the wax is effectively obtained when at least 1 mass part is added, while an excellent wax dispersibility is obtained by having the amount of addition be not more than 20 mass parts.

The toner of the present invention may be a magnetic toner or may be a nonmagnetic toner.

When the toner of the present invention is used in the form of a nonmagnetic toner, as necessary a carbon black and/or one or two or more of the heretofore known so-called pigments and dyes can be used as a colorant. Per 100.0 mass parts of the binder resin, the amount of colorant addition is preferably at least 0.1 mass parts and not more than 60.0 mass parts and more preferably is at least 0.5 mass parts and not more than 50.0 mass parts.

Magnetic iron oxide particles can be used when the toner of the present invention is used in the form of a magnetic toner. Specific examples are magnetic iron oxide particles of, e.g., magnetite, maghemite, and ferrite, and magnetic iron oxide particles that contain another metal oxide. Magnetite ($Fe_3O_4$), ferric oxide ($\gamma$-$Fe_2O_3$), zinc iron oxide ($ZnFe_2O_4$), yttrium iron oxide ($Y_3Fe_5O_{12}$), cadmium iron oxide ($Cd_3Fe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), and so forth are already known. A finely divided powder of magnetite or $\gamma$-ferric oxide are particularly favorable magnetic iron oxide particles. A single selection from these magnetic iron oxide particles may be used or a combination of two or more may be selected and used.

The magnetic iron oxide particles used in the toner of the present invention more preferably have an octahedral shape, which has a better dispersibility in the toner.

A charge control agent can be used in the toner of the present invention in order to stabilize its charging characteristics. While the charge control agent content will also vary as a function of its type and the properties of the other materials that make up the toner particles, it is generally preferably at least 0.1 mass parts and not more than 10 mass parts per 100 mass parts of the binder resin in the toner, while at least 0.1 mass parts and not more than 5 mass parts is more preferred. One or two or more of the various charge control agents can be used in conformity with the toner type and application.

The following are examples of charge control agents for controlling the toner to a negative charging performance: organometal complexes (monoazo metal complexes, acetylacetone metal complexes) and the metal complexes and metal salts of aromatic hydroxycarboxylic acids and aromatic dicarboxylic acids. Additional examples for controlling the toner to a negative charging performance are aromatic mono- and polycarboxylic acids and their metal salts and anhydrides, and esters and phenol derivatives such as bisphenols. Preferred among the preceding are monoazo metal complexes or metal salts, which provide stable charging characteristics. A charge control resin may also be used, and it may be used in combination with the charge control agents indicated in the preceding.

The following are examples of charge control agents for controlling the toner to a positive charging performance: nigrosine and its modifications by fatty acid metal salts; quaternary ammonium salts such as tributylbenzylammonium 1-hydroxy-4-naphthosulfonate and tetrabutylammonium tetrafluoroborate and their analogues; onium salts such as phosphonium salts, and their lake pigments; triphenylmethane dyes and their lake pigments (the laking agent can be exemplified by phosphotungstic acid, phosphomolybdic acid, phosphotungstomolybdic acid, tannic acid, lauric acid, gallic acid, ferricyanic acid, and ferrocyanic acid); and metal salts of higher fatty acids. A single one of these or a combination of two or more can be used by the present invention. Charge control agents such as nigrosine compounds and quaternary ammonium salts are preferred among the preceding.

The use is preferred for the toner of the present invention of a flowability improver that has a smaller number-average primary particle diameter and a high ability to impart flowability to the toner surface. Any flowability improver can be used that, through its external addition to the toner, is able to increase the flowability pre-versus-post addition. The following are examples: finely divided vinylidene fluoride powder; fluororesin powders such as finely divided polytetrafluoroethylene powder; finely divided silica powders such as finely divided silica powder made by a wet method and finely divided silica powder made by a dry method, and treated finely divided silica powders provided by subjecting these finely divided silica powders to a surface treatment with a treatment agent such as a silane coupling agent, a titanium coupling agent, or a silicone oil; finely divided titanium oxide powder; finely divided alumina powder; treated finely divided titanium oxide powder; and treated finely divided aluminum oxide powder. The flowability improver preferably has a specific surface area, as measured by the BET method using nitrogen adsorption, of at least 30 $m^2/g$ and more preferably of at least 50 $m^2/g$ and not more than 300 $m^2/g$. The flowability improver is added, per 100 mass parts of the toner, preferably at at least 0.01 mass parts and not more than 8.0 mass parts and more preferably at at least 0.1 mass parts and not more than 4.0 mass parts.

Other external additives may also be added to the toner of the present invention on an optional basis. Examples in this regard are auxiliary charging agents, agents that impart electroconductivity, anti-caking agents, release agents for heated roller fixing, and finely divided resin particles and finely divided inorganic particles that function as an abrasive.

The abrasive can be exemplified by cerium oxide powder, silicon carbide powder, and strontium titanate powder. The toner of the present invention can be obtained by thoroughly mixing with these external additives using a mixer such as, for example, a Henschel mixer.

The method of producing the toner of the present invention (pulverization method) is described in the following, although this should not be construed as limiting. For example, the binder resin A, the binder resin B, the wax, and the other additives used on an optional basis are first thoroughly mixed using a mixer such as a Henschel mixer or ball mill. This is followed by melt-kneading using a heated kneader such as a heated roll, kneader, or extruder. After cooling and solidification, pulverization and classification are carried out to obtain the toner. In addition, for example, finely divided silica particles and so forth may on an optional basis also be thoroughly mixed into the toner using a mixer, e.g., a Henschel mixer, to provide a toner to which a flowability improver has been added.

The mixer can be exemplified by the following: Henschel mixer (Mitsui Mining Co., Ltd.); Supermixer (Kawata Mfg. Co., Ltd.); Ribocone (Okawara Corporation); Nauta mixer, Turbulizer, and Cyclomix (Hosokawa Micron Corporation); Spiral Pin Mixer (Pacific Machinery & Engineering Co., Ltd.); and Loedige Mixer (Matsubo Corporation).

The kneader can be exemplified by the following: KRC Kneader (Kurimoto, Ltd.); Buss Ko-Kneader (Buss Corp.); TEM extruder (Toshiba Machine Co., Ltd.); TEX twin-screw kneader (The Japan Steel Works, Ltd.); PCM Kneader (Ikegai Ironworks Corporation); three-roll mills, mixing roll mills, and kneaders (Inoue Manufacturing Co., Ltd.); Kneadex (Mitsui Mining Co., Ltd.); model MS pressure kneader and Kneader-Ruder (Moriyama Mfg. Co., Ltd.); and Banbury mixer (Kobe Steel, Ltd.).

The pulverizer can be exemplified by the following: Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

The classifier can be exemplified by the following: Classiel, Micron Classifier, and Spedic Classifier (Seishin Enterprise Co., Ltd.); Turbo Classifier (Nisshin Engineering Inc.); Micron Separator, Turboplex (ATP), TSP Separator, and TTSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa Shoji Co., Ltd.).

Screening devices that can be used to screen the coarse particles can be exemplified by the following: Ultrasonic (Koei Sangyo Co., Ltd.), Rezona Sieve and Gyro-Sifter (Tokuju Corporation), Vibrasonic System (Dalton Co., Ltd.), Soniclean (Sintokogio, Ltd.), Turbo Screener (Turbo Kogyo Co., Ltd.), Microsifter (Makino Mfg. Co., Ltd.), and circular vibrating sieves.

The methods used to measure various properties germane to the present invention are described below.

(1) Melting Point of the Aliphatic Compound and the Wax

The melting point of the aliphatic compound and the wax is measured in the present invention based on ASTM D3418-82 using a "Q2000" differential scanning calorimeter (TA Instruments, Inc.).

Temperature correction in the instrument detection section is carried out using the melting points of indium and zinc, while the heat of fusion of indium is used to correct the amount of heat.

Specifically, approximately 5 mg of the sample (the aliphatic compound or the wax) is precisely weighed out and this is introduced into an aluminum pan. Using an empty aluminum pan as the reference, the measurement is performed at a ramp rate of 10° C./min in the measurement temperature range from 30° C. to 200° C.

For the measurement, the temperature is raised to 200° C. and then dropped to 30° C. and is thereafter raised again. The melting point of the aliphatic compound or wax is taken to be the peak temperature of the maximum endothermic peak in the DSC curve in the temperature range from 30° C. to 200° C. for this second temperature ramp-up step.

(2) Softening Point of the Binder Resin

Measurement of the softening point of the binder resin is performed according to the manual provided with the instrument, using a "Flowtester CFT-500D Flow Property Evaluation Instrument", a constant load extrusion-type capillary rheometer from Shimadzu.

With this instrument, while a constant load is applied by a piston from the top of the measurement sample, the measurement sample filled in a cylinder is heated and melted and the melted measurement sample is extruded from a die at the bottom of the cylinder; a flow curve showing the relationship between piston stroke and temperature is obtained from this.

The "melting temperature by the ½ method", as described in the manual provided with the "Flowtester CFT-500D Flow Property Evaluation Instrument", is used as the softening point in the present invention. The melting temperature by the ½ method is determined as follows. Letting Smax be the piston stroke at the completion of outflow and Smin be the piston stroke at the start of outflow, ½ of the difference between Smax and Smin is determined to give the value X ($X=(Smax-Smin)/2$). The temperature of the flow curve when the piston stroke in the flow curve reaches the sum of X and Smin is the melting temperature by the ½ method.

The measurement sample is prepared by subjecting 1.0 g of the binder resin to compression molding for approximately 60 seconds at approximately 10 MPa in a 25° C. atmosphere using a tablet compression molder (NT-100H from NPa System Co., Ltd.) to provide a cylindrical shape with a diameter of approximately 8 mm.

The measurement conditions with the CFT-500D are as follows.

test mode: rising temperature method
start temperature: 30° C.
saturated temperature: 200° C.
measurement interval: 1.0° C.
heating rate: 4.0° C./min
piston cross section area: 1.000 $cm^2$
test load (piston load): 10.0 kgf (0.9807 MPa)
preheating time: 300 seconds
diameter of die orifice: 1.0 mm
die length: 1.0 mm (3) Measurement of the Weight-Average Particle Diameter (D4) of the Toner The weight-average particle diameter (D4) of the toner is calculated using a "Coulter Counter Multisizer 3" (registered trademark of Beckman Coulter, Inc.), which is a precision particle diameter distribution analyzer that uses the pore electrical resistance method and is equipped with a 100 μm aperture tube, and using the "Beckman Coulter Multisizer 3 Version 3.51" dedicated software (from Beckman Coulter, Inc.) provided with the instrument for setting the measurement conditions and performing measurement data analysis, to perform measurements at 25,000 channels for the number of effective measurement channels and to carry out analysis of the measurement data.

A solution of special-grade sodium chloride dissolved in ion-exchanged water and brought to a concentration of approximately 1 mass %, for example, "ISOTON II" (Beckman Coulter, Inc.), can be used for the aqueous electrolyte solution used for the measurement.

The dedicated software is set as follows prior to running the measurement and analysis.

On the "Change Standard Operating Method (SOM)" screen of the dedicated software, the total count number for the control mode is set to 50,000 particles, the number of measurements is set to 1, and the value obtained using "10.0 μm standard particles" (from Beckman Coulter, Inc.) is set for the Kd value. The threshold value and noise level are automatically set by pressing the threshold value/noise level measurement button. The current is set to 1,600 μA, the gain is set to 2, the electrolyte solution is set to ISOTON II, and "flush aperture tube after measurement" is checked.

On the "pulse-to-particle diameter conversion setting" screen of the dedicated software, the bin interval is set to logarithmic particle diameter, the particle diameter bin is set to 256 particle diameter bins, and the particle diameter range is set to from 2 μm to 60 μm.

The specific measurement method is as follows.

(1) Approximately 200 mL of the above-described aqueous electrolyte solution is introduced into the glass 250-mL roundbottom beaker provided for use with the Multisizer 3 and this is then set into the sample stand and counterclockwise stirring is performed with a stirring rod at 24 rotations per second. Dirt and bubbles in the aperture tube are removed using the "aperture flush" function of the dedicated software.

(2) Approximately 30 mL of the above-described aqueous electrolyte solution is introduced into a glass 100-mL flatbottom beaker. To this is added the following as a dispersing agent: approximately 0.3 mL of a dilution prepared by diluting "Contaminon N" (a 10 mass % aqueous solution of a neutral pH 7 detergent for cleaning precision measurement instrumentation, comprising a nonionic surfactant, an anionic surfactant, and an organic builder, from Wako Pure Chemical Industries, Ltd.) approximately 3-fold on a mass basis with ion-exchanged water.

(3) A prescribed amount of ion-exchanged water is introduced into the water tank of an "Ultrasonic Dispersion System Tetora 150" ultrasound disperser (Nikkaki Bios Co., Ltd.), which has an output of 120 W and is equipped with two oscillators oscillating at 50 kHz and configured with a phase shift of 180°, and approximately 2 mL of the above-described Contaminon N is added to this water tank.

(4) The beaker from (2) is placed in the beaker holder of the ultrasound disperser and the ultrasound disperser is activated. The height position of the beaker is adjusted to provide the maximum resonance state for the surface of the aqueous electrolyte solution in the beaker.

(5) While exposing the aqueous electrolyte solution in the beaker of (4) to the ultrasound, approximately 10 mg of the toner is added in small portions to the aqueous electrolyte solution and is dispersed. The ultrasound dispersing treatment is continued for another 60 seconds. During ultrasound dispersion, the water temperature in the water tank is adjusted as appropriate to be at least 10° C. to no more than 40° C.

(6) Using a pipette, the aqueous electrolyte solution from (5) containing dispersed toner is added dropwise into the roundbottom beaker of (1) that is installed in the sample stand and the measurement concentration is adjusted to approximately 5%. The measurement is run until the number of particles measured reaches 50,000.

(7) The measurement data is analyzed by the dedicated software provided with the instrument to calculate the weight-average particle diameter (D4). When the dedicated software is set to graph/volume %, the "average diameter" on the analysis/volume statistics (arithmetic average) screen is the weight-average particle diameter (D4).

EXAMPLES

The present invention is specifically described in the following using examples, but the invention is in no way limited to or by these examples. Unless specifically indicated otherwise, parts and % in the examples and comparative examples are in all instances on a mass basis.

<Alcohol-Modified Wax 1 Production Example>

1,000 g of a paraffin wax (number-average molecular weight (Mn): 400) was introduced as the starting material into a cylindrical glass reactor and the temperature was raised to 140° C. while blowing in a small amount of nitrogen gas (3.5 L/minute). 26.1 g (0.41 moles) of a mixed catalyst of boric acid/boric anhydride=1.44 (molar ratio) was added, followed by running a reaction for 2 hours at 180° C. while blowing in air (20 L/minute) and nitrogen (15 L/minute). After the completion of the reaction, an equal amount of hot water (95° C.) was added to the reaction mixture and the reaction mixture was hydrolyzed; this was followed by standing at quiescence, take off of the hydrocarbon wax that separated into the upper layer, and washing the recovered hydrocarbon wax with water to obtain an alcohol-modified wax 1. The melting point was 75° C.

<Alcohol-Modified Wax 2 Production Example>

The same procedure as in the Alcohol-modified Wax Production Example was carried out, but using a paraffin wax (Mn: 327) for the starting material, to obtain an alcohol-modified wax 2. The melting point was 65° C.

<Alcohol-Modified Wax 3 Production Example>

The same procedure as in the Alcohol-modified Wax Production Example was carried out, but using a Fischer-Tropsch wax (Mn: 450) for the starting material, to obtain an alcohol-modified wax 3. The melting point was 80° C.

<Alcohol-Modified Wax 4 Production Example>

The same procedure as in the Alcohol-modified Wax Production Example was carried out, but using a Fischer-Tropsch wax (Mn: 720) for the starting material, to obtain an alcohol-modified wax 4. The melting point was 85° C.

<Alcohol-Modified Wax 5 Production Example>

The same procedure as in the Alcohol-modified Wax Production Example was carried out, but using a paraffin wax (Mn: 300) for the starting material, to obtain an alcohol-modified wax 5. The melting point was 60° C.

<Binder Resin A-1 Production Example>

(Polyester Unit Formulation)

| | |
|---|---|
| bisphenol A/ethylene oxide: (2.2 mol adduct) | 100.0 mol parts |
| terephthalic acid: | 65.0 mol parts |
| trimellitic anhydride: | 25.0 mol parts |
| acrylic acid: | 10.0 mol parts |

75 mass parts of the monomer mixture constituting the polyester unit as indicated above and 5 mass parts of alcohol-modified wax 1 (melting point 75° C.) were introduced into a four-neck flask; a pressure reduction apparatus, a water separator, a nitrogen gas introduction apparatus, a temperature measurement apparatus, and a stirring apparatus were installed; and stirring was performed at 160° C. under a nitrogen atmosphere.

To this were added dropwise over 4 hours from a dropping funnel 20 mass parts of the vinyl copolymer monomer (90.0 mol parts of styrene and 10.0 mol parts of 2-ethylhexyl acrylate) constituting the vinyl polymer unit and 1 mass part of benzoyl peroxide as polymerization initiator and a reaction was run for 5 hours at 160° C.

The temperature was then raised to 230° C.; 0.2 mass parts of titanium tetrabutoxide—with reference to the total amount of the monomer component constituting the polyester unit—was added; and a polymerization reaction was run until the softening point given in Table 1 was reached. Removal from the vessel after the completion of the reaction, cooling, and pulverization then yielded binder resin A-1.

<Binder Resins A-2 to A-7 Production Examples>

Binder resins A-2 to A-7 having the softening points given in Table 1 were obtained according to the Binder Resin A-1 Production Example, but changing the aliphatic compound as shown in Table 1.

<Binder Resins A-8 to A-13 Production Examples>

Binder resins A-8 to A-13 having the softening points given in Table 1 were obtained according to the Binder Resin A-1 Production Example, but changing the aliphatic compound as shown in Table 1 and changing the catalyst for polyester unit polymerization to dibutyltin oxide (indicated as "tin" in the table). The acid-modified wax was a wax provided by the acrylic acid modification of a polyethylene wax and had the melting point given in Table 1.

<Binder Resin B-1 Production Example>

| | |
|---|---|
| bisphenol A/ethylene oxide: (2.2 mol adduct) | 40.0 mol parts |
| bisphenol A/propylene oxide: (2.2 mol adduct) | 40.0 mol parts |
| ethylene glycol: | 20.0 mol parts |
| terephthalic acid: | 100.0 mol parts |

95 mass parts of the monomer constituting the polyester unit as indicated above, 5 mass parts of a primary alcohol-modified wax (wax provided by modifying one terminal of a polyethylene with the hydroxyl group, melting point=105° C.), and 500 ppm titanium tetrabutoxide were introduced into a 5-L autoclave. A reflux condenser, a water separator, a $N_2$ gas introduction tube, a thermometer, and a stirrer were installed thereon and a polycondensation reaction was run at 230° C. while introducing $N_2$ gas into the autoclave. The reaction time was adjusted to provide the softening point given in Table 2, followed by removal from the vessel after the completion of the reaction, cooling, and pulverization to yield binder resin B-1.

<Binder Resins B-2 to B-8 Production Examples>

Binder resins B-2 to B-8 having the softening points given in Table 2 were obtained according to the Binder Resin B-1 Production Example, but changing the aliphatic compound as shown in Table 2. The primary alcohol-modified wax was a wax provided by the modification of one terminal of a polyethylene with the hydroxyl group and had the melting point shown in Table 2; the acid-modified wax was a wax provided by the modification of a polyethylene wax with acrylic acid and had the melting point given in Table 2.

<Binder Resin B-9 Production Example>

| | |
|---|---|
| bisphenol A/propylene oxide: (2.2 mol adduct) | 100.0 mol parts |
| terephthalic acid: | 65.0 mol parts |
| acrylic acid: | 10.0 mol parts |

75 mass parts of the monomer mixture constituting the polyester unit as indicated above and 5 mass parts of an acid-modified wax (wax provided by the modification of a polyethylene wax by acrylic acid, melting point 90° C.) were introduced into a four-neck flask; a pressure reduction apparatus, a water separator, a nitrogen gas introduction apparatus, a temperature measurement apparatus, and a stirring apparatus were installed; and stirring was performed at 160° C. under a nitrogen atmosphere.

To this were added dropwise over 4 hours from a dropping funnel 20 mass parts of the vinyl copolymer monomer (90.0 mol parts of styrene and 10.0 mol parts of 2-ethylhexyl acrylate) constituting the vinyl polymer unit and 1 mass part of benzoyl peroxide as a polymerization initiator and a reaction was run for 5 hours at 160° C.

The temperature was then raised to 230° C.; 0.2 mass parts of dibutyltin oxide—with reference to the total amount of the monomer component constituting the polyester unit—was added; and a polymerization reaction was run until the softening point given in Table 2 was reached. Removal from the vessel after the completion of the reaction, cooling, and pulverization then yielded binder resin B-9.

<Binder Resins B-10 to B-14 Production Examples>

Binder resins B-10 to B-14 having the softening points given in Table 2 were obtained according to the Binder Resin B-9 Production Example, but changing the aliphatic compound as shown in Table 2. The acid-modified wax was a wax provided by the acrylic acid modification of a polyethylene wax and had the melting point given in Table 2.

TABLE 1

| binder resin No. | softening point (° C.) | melting point of the aliphatic compound (° C.) | metal species of catalyst | aliphatic compound |
|---|---|---|---|---|
| A-1 | 135 | 75 | titanium | alcohol-modified wax 1 |
| A-2 | 135 | 65 | titanium | alcohol-modified wax 2 |

TABLE 1-continued

| binder resin No. | softening point (° C.) | melting point of the aliphatic compound (° C.) | metal species of catalyst | aliphatic compound |
|---|---|---|---|---|
| A-3 | 135 | 80 | titanium | alcohol-modified wax 3 |
| A-4 | 125 | 85 | titanium | alcohol-modified wax 4 |
| A-5 | 145 | 85 | titanium | alcohol-modified wax 4 |
| A-6 | 149 | 60 | titanium | alcohol-modified wax 5 |
| A-7 | 121 | 60 | titanium | alcohol-modified wax 5 |
| A-8 | 121 | 85 | tin | acid-modified wax |
| A-9 | 121 | 60 | tin | acid-modified wax |
| A-10 | 121 | 88 | tin | acid-modified wax |
| A-11 | 121 | 53 | tin | stearyl alcohol |
| A-12 | 151 | 53 | tin | stearyl alcohol |
| A-13 | 118 | 53 | tin | stearyl alcohol |

TABLE 2

| binder resin No. | softening point (° C.) | melting point of the aliphatic compound (° C.) | resin | metal species of catalyst | aliphatic compound |
|---|---|---|---|---|---|
| B-1 | 95 | 105 | polyester | titanium | primary alcohol-modified wax |
| B-2 | 95 | 95 | polyester | titanium | primary alcohol-modified wax |
| B-3 | 95 | 110 | polyester | titanium | primary alcohol-modified wax |
| B-4 | 85 | 90 | polyester | titanium | primary alcohol-modified wax |
| B-5 | 105 | 120 | polyester | titanium | primary alcohol-modified wax |
| B-6 | 115 | 90 | polyester | titanium | primary alcohol-modified wax |
| B-7 | 80 | 120 | polyester | titanium | primary alcohol-modified wax |
| B-8 | 80 | 90 | polyester | titanium | acid-modified wax |
| B-9 | 80 | 90 | hybrid | tin | acid-modified wax |
| B-10 | 80 | 122 | hybrid | tin | acid-modified wax |
| B-11 | 80 | 88 | hybrid | tin | acid-modified wax |
| B-12 | 78 | 88 | hybrid | tin | acid-modified wax |
| B-13 | 117 | 88 | hybrid | tin | acid-modified wax |
| B-14 | 117 | 122 | hybrid | tin | acid-modified wax |

Example 1

Toner No. 1 Production Example

| | |
|---|---|
| binder resin A-1: | 70 mass parts |
| binder resin B-1: | 30 mass parts |
| Fischer-Tropsch wax: | 2 mass parts |
| (Sasol Wax GmbH, C105, melting point = 105° C.) | |

-continued

| | |
|---|---|
| magnetic iron oxide particles a: (number-average particle diameter = 0.14 μm, Hc (coercive force) = 11.5 kA/m, σs (saturation magnetization) = 90 $Am^2/kg$, σr (residual magnetization) = 16 $Am^2/kg$) | 90 mass parts |
| T-77 charge control agent: | 2 mass parts |

(Hodogaya Chemical Co., Ltd.)

These starting materials were pre-mixed using a Henschel mixer followed by melt-kneading using a twin-screw kneading extruder. The residence time was controlled here so as to bring the temperature of the kneaded resin to 150° C. The resulting kneaded mass was cooled, coarsely pulverized with a hammer mill, and then pulverized using a Turbo Mill to obtain a finely pulverized powder. This finely pulverized powder was classified using a Coanda effect-based multi-grade classifier (Elbow Jet, Nittetsu Mining Co., Ltd.) to obtain toner particles having a weight-average particle diameter (D4) of 7.3 μm. 1.0 mass part of a finely divided hydrophobic silica powder (specific surface area by nitrogen adsorption measured by the BET method=140 $m^2/g$, treated with hexamethyldisilazane for the hydrophobic treatment) and 3.0 mass parts of strontium titanate (volume-average particle diameter=1.6 μm) were externally added and mixed into 100 mass parts of the toner particles followed by screening with a mesh having an aperture of 150 μm to obtain toner No. 1. The following evaluations were performed on toner No. 1. The results of the evaluations are given in Table 4.

<Evaluation of the Low-Temperature Fixability>

The evaluation of the low-temperature fixability was carried out in a normal-temperature, normal-humidity (23° C., 50% RH) environment using a commercial digital copier (image RUNNER 4051 from Canon, Inc.) for which the process speed had been modified to 252 mm/s. An 80 $g/m^2$ paper (OCE RED LABEL, A3) was used as the paper in the evaluation. Halftone patches with a size of 20 mm×20 mm were printed evenly on the A3 paper at nine points and the developing bias was set to provide an image density of 0.6. Temperature control at the fixing unit was then changed to the desired temperature control; cooling was carried out until the temperature of the pressure roller at the fixing unit reached 30° C. or below; and a continuous paper feed was performed for 20 sheets single-sided. The first, third, fifth, tenth, and twentieth sheet were sampled out to provide the samples for the evaluation of the low-temperature fixability. With a load of 4.9 kPa applied to the resulting fixed image, the fixed image was rubbed with lens-cleaning paper for 5 back-and-forth excursions. The percentage decline in the image density at the particular temperature was taken to be the worst average value, among the 5 samples, for the percentage decline in image density at the nine points pre-versus-post rubbing. Fixing temperature control was changed in 5° C. increments from 170° C. to 210° C. and the fixing onset temperature was taken to be the fixing temperature setting at which the percentage decline in the image density was 20% or less, and the low-temperature fixability was evaluated on the basis of this fixing onset temperature.

The image density was measured with a Macbeth densitometer (RD-914 from GretagMacbeth) using an SPI auxiliary filter.

(Evaluation Scale)

A (very good): the fixing onset temperature is less than 180° C.

B (good): the fixing onset temperature is equal to or greater than 180° C. but less than 190° C.

C (ordinary): the fixing onset temperature is equal to or greater than 190° C. but less than 200° C.

D (somewhat poor): the fixing onset temperature is equal to or greater than 200° C. but less than 210° C.

E (poor): the fixing onset temperature is equal to or greater than 210° C.

<Evaluation of the Fogging>

For the fogging, the solid white image on the second print was evaluated using the scale given below, after a ten-thousand print durability test in a low-temperature, low-humidity (15° C., 10% RH) environment using a commercial digital copier (image RUNNER 4051 from Canon, Inc.) for which the process speed had been modified to 252 mm/s. The measurement was carried out using a reflectometer (Model TC-6DS Reflectometer, from Tokyo Denshoku Co., Ltd.). Letting Ds be the poorest value for the reflection density in the white background after image formation and letting Dr be the average reflection density of the transfer material prior to image formation, the fogging was evaluated using the amount of fogging Dr−Ds. As a consequence, a smaller numerical value indicates a better suppression of fogging.

(Evaluation Scale)

A (very good): the fogging is less than 1.0

B (good): the fogging is equal to or greater than 1.0 but less than 2.0

C (ordinary): the fogging is equal to or greater than 2.0 but less than 3.0

D (somewhat poor): the fogging is equal to or greater than 3.0 but less than 4.0

E (poor): the fogging is equal to or greater than 4.0 but less than 5.0

<The Endurance Stability>

For the endurance stability, a durability test was carried out in a high-temperature, high-humidity (30° C., 80% RH) environment using a commercial digital copier (image RUNNER 4051 from Canon, Inc.) for which the process speed had been modified to 252 mm/s. The developing bias was set to provide an initial reflection density of 1.4, and ten thousand prints of a solid white image with a print percentage of 0% were output. After the ten-thousandth print had been output, an original image was output, wherein this original image had a 20 mm-square solid black patch at 5 locations within the development region, and the endurance stability was evaluated by comparing the density difference between the average density at these 5 points and the initial image density.

For the image density, the relative density was measured versus an image of the white background where the original density was 0.00; the measurements were made using a "Macbeth Reflection Densitometer RD918" (GretagMacbeth GmbH).

(Evaluation Scale)

A (very good): the density difference is less than 0.10

B (good): the density difference is equal to or greater than 0.10 but less than 0.20

C (ordinary): the density difference is equal to or greater than 0.20 but less than 0.30

D (somewhat poor): the density difference is equal to or greater than 0.30 but less than 0.40

E (poor): the density difference is equal to or greater than 0.40

The toner of Example 1 had a score of A on all of the preceding evaluations.

Examples 2 to 14

Toner Nos. 2 to 14 Production Examples

Toner Nos. 2 to 14 were prepared by proceeding as in Example 1, but changing the formulation as indicated in Table 3. These toner Nos. 2 to 14 were evaluated by the same methods as in Example 1. The results of the evaluations are given in Table 4.

The toners of Examples 2 and 3 gave the same evaluation results as for Example 1. It is thought here that a more preferred range for the melting point of the aliphatic compound for the binder resin B is at least 95° C. and not more than 110° C.

The toner in Example 4 received a fogging score of B. It is thought here that the lower melting point component of the wax did have some effect on the binder resin B since the melting point of the aliphatic compound for the binder resin B was 90° C.

The toner in Example 5 received a fogging score of B. It is thought here that there was some effect on the wax dispersibility since the melting point of the aliphatic compound for the binder resin B was 120° C.

The toner in Example 6 received a score of B for the low-temperature fixability. It is thought here that the low-temperature fixability was somewhat impaired because the softening point of the binder resin B was high at 115° C.

The toner in Example 7 received a score of B for the low-temperature fixability. Here it is thought that, because the softening point of the binder resin B was low at 80° C., the fix strength for the fixed toner was reduced and the low-temperature fixability was then somewhat degraded.

The toners in Examples 8 and 9 had a score of B for the endurance stability. Here it is thought that, because the melting point of the aliphatic compound for the binder resin A was high at 85° C., the lower melting point component of the wax also influenced the binder resin B, and as a consequence the endurance stability was somewhat degraded.

The toner in Example 10 had a fogging score of C. It is thought here that the dispersibility with the binder resin B was somewhat impaired because the softening point of the binder resin A was high at 149° C.

The toner in Example 11 had a fogging score of C. It is thought here that, because the softening point of the binder resin A was low at 121° C., the dispersibility with the binder resin B was facilitated while the wax dispersibility was somewhat degraded.

The toners of Examples 12 and 13 had scores of C for the endurance stability. Here it is thought that the lower melting point component of the wax had an effect on the binder resin B because the difference between the melting point of the aliphatic compound for the binder resin A and the melting point of the aliphatic compound for the binder resin B was low at 5° C.

A score of C for the low-temperature fixability was received in Example 14. Here it is thought that the low-temperature fixability was somewhat impaired by the change in the binder resin B to a polyester/styrene-acrylic hybrid resin.

Comparative Examples 1 to 8

Toner Nos. 15 to 22 were prepared by proceeding as in Example 1, but changing the formulation as indicated in Table 3. These toner Nos. 15 to 22 were evaluated by the same methods as in Example 1. The results of the evaluations are given in Table 4.

The scores for the endurance stability and fogging were D in Comparative Example 1. It is thought here that, because the melting point of the aliphatic compound for the binder resin B was high at 122° C., the plasticizing effect of the aliphatic compound and its contribution to the wax dispersibility were diminished.

The scores for the endurance stability and fogging were D in Comparative Example 2. This was thought to be due to a high plasticizing effect and thus a softening of the toner because the melting point of the aliphatic compound for the binder resin B was low at 88° C.

The score for the low-temperature fixability was D in Comparative Example 3. Here it is thought that, because the softening point of the binder resin B was low at 78° C., the fix strength for the fixed toner was reduced and the low-temperature fixability was then degraded.

The score for the low-temperature fixability was D in Comparative Example 4. This is thought to occur because the toner was too hard because the softening point of the binder resin B was high at 117° C.

The score for the endurance stability was E in Comparative Example 5. This is thought to be due to a plasticization of the binder resin B by the lower melting point component of the wax because the melting point of the aliphatic compound for the binder resin A was high at 88° C.

The score for the endurance stability was E in Comparative Example 6. This is thought to be due to a deterioration in the wax dispersibility because the melting point of the aliphatic compound for the binder resin A was low at 53° C.

The score for the fogging was E in Comparative Example 7. This is thought to be due to a deterioration in the dispersion with the binder resin B because the softening point of the binder resin A was high at 151° C.

The score for the fogging was E in Comparative Example 8. Here it is thought that, because the softening point of the binder resin A was low at 118° C., the dispersibility with the binder resin B was excellent, but the dispersibility with the wax underwent a deterioration.

TABLE 3

| toner No. | binder resin A | number of parts | binder resin B | number of parts | release agent | melting point (° C.) |
|---|---|---|---|---|---|---|
| toner 1 | A-1 | 70 | B-1 | 30 | Fischer-Tropsch wax | 105 |
| toner 2 | A-1 | 70 | B-2 | 30 | Fischer-Tropsch wax | 105 |
| toner 3 | A-1 | 70 | B-3 | 30 | Fischer-Tropsch wax | 105 |
| toner 4 | A-1 | 70 | B-4 | 30 | Fischer-Tropsch wax | 105 |
| toner 5 | A-1 | 70 | B-5 | 30 | Fischer-Tropsch wax | 105 |
| toner 6 | A-2 | 70 | B-6 | 30 | Fischer-Tropsch wax | 105 |
| toner 7 | A-3 | 70 | B-7 | 30 | Fischer-Tropsch wax | 105 |
| toner 8 | A-4 | 70 | B-7 | 30 | Fischer-Tropsch wax | 105 |
| toner 9 | A-5 | 70 | B-7 | 30 | Fischer-Tropsch wax | 105 |
| toner 10 | A-6 | 90 | B-7 | 10 | polypropylene wax | 152 |
| toner 11 | A-7 | 10 | B-7 | 90 | polypropylene wax | 152 |
| toner 12 | A-8 | 5 | B-8 | 95 | polypropylene wax | 152 |
| toner 13 | A-8 | 95 | B-8 | 5 | polypropylene wax | 152 |
| toner 14 | A-8 | 95 | B-9 | 5 | polypropylene wax | 152 |
| toner 15 | A-9 | 95 | B-10 | 5 | polypropylene wax | 152 |
| toner 16 | A-8 | 95 | B-11 | 5 | polypropylene wax | 152 |
| toner 17 | A-8 | 95 | B-12 | 5 | polypropylene wax | 152 |
| toner 18 | A-8 | 95 | B-13 | 5 | polypropylene wax | 152 |
| toner 19 | A-10 | 95 | B-13 | 5 | polypropylene wax | 152 |
| toner 20 | A-11 | 95 | B-14 | 5 | polypropylene wax | 152 |
| toner 21 | A-12 | 95 | B-14 | 5 | polypropylene wax | 152 |
| toner 22 | A-13 | 95 | B-14 | 5 | polypropylene wax | 152 |

TABLE 4

| Example No. | toner No. | low-temperature fixability | fogging | endurance stability |
|---|---|---|---|---|
| Example 1 | toner 1 | A | A | A |
| Example 2 | toner 2 | A | A | A |
| Example 3 | toner 3 | A | A | A |
| Example 4 | toner 4 | A | B | A |

TABLE 4-continued

| Example No. | toner No. | low-temperature fixability | fogging | endurance stability |
|---|---|---|---|---|
| Example 5 | toner 5 | A | B | A |
| Example 6 | toner 6 | B | B | A |
| Example 7 | toner 7 | B | B | A |
| Example 8 | toner 8 | B | B | B |
| Example 9 | toner 9 | B | B | B |
| Example 10 | toner 10 | B | C | B |
| Example 11 | toner 11 | B | C | B |
| Example 12 | toner 12 | B | C | C |
| Example 13 | toner 13 | B | C | C |
| Example 14 | toner 14 | C | C | C |
| Comparative Example 1 | toner 15 | C | D | D |
| Comparative Example 2 | toner 16 | C | D | D |
| Comparative Example 3 | toner 17 | D | D | D |
| Comparative Example 4 | toner 18 | D | D | D |
| Comparative Example 5 | toner 19 | D | D | E |
| Comparative Example 6 | toner 20 | D | D | E |
| Comparative Example 7 | toner 21 | D | E | E |
| Comparative Example 8 | toner 22 | D | E | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-134274, filed Jun. 26, 2013, which is hereby incorporated by reference herein in its entirety.

What is claimed is:

1. A toner comprising a binder resin and a wax, wherein the binder resin contains a binder resin A and a binder resin B, the binder resin A:

i) has a softening point of at least 120° C. and not more than 150° C.;

ii) has a polyester unit; and iii) has a terminal of which a first aliphatic compound has been condensed, the first aliphatic compound being selected from the group consisting of an aliphatic monocarboxylic acid having a melting point of 60° C. or more and not more than 85° C., and an aliphatic monoalcohol having a melting point of 60° C. or more and not more than 85° C., and the binder resin B:

i) has a softening point of at least 80° C. and not more than 115° C.;

ii) has a polyester unit; and iii) has a terminal of which a second aliphatic compound has been condensed, the second aliphatic compound being selected from the group consisting of an aliphatic monocarboxylic acid having a melting point of 90° C. or more and not more than 120° C., and an aliphatic monoalcohol having a melting point of 90° C. or more and not more than 120° C.

2. The toner according to claim 1, wherein the binder resin B is a polyester resin.

3. The toner according to claim 1, wherein the binder resin A is a hybrid resin in which a vinyl polymer unit is chemically bonded to a polyester unit.

4. The toner according to claim 1, wherein a mixing ratio between the binder resin A and the binder resin B (binder resin A: binder resin B) is 10:90 to 90:10 on a mass basis.

5. The toner according to claim 1, wherein the softening point of the binder resin A is at least 125° C. and not more than 145° C.

6. The toner according to claim 1, wherein the melting point of the first aliphatic compound is at least 65° C. and not more than 80° C.

7. The toner according to claim 1, wherein the softening point of the binder resin B is at least 85° C. and not more than 105° C.

8. The toner according to claim 1, wherein the melting point of the second aliphatic compound is at least 95° C. and not more than 110° C.

9. The toner according to claim 1, wherein, designating the softening point of the binder resin A as Tm(A) and the softening point of the binder resin B as Tm(B), Tm(A)−Tm(B) is at least 20° C. and not more than 55° C.

10. The toner according to claim 1, wherein, designating the melting point of the first aliphatic compound as MpA and the melting point of the second aliphatic compound as MpB, the difference (MpB−MpA) is at least 15° C. and not more than 60° C.

* * * * *